United States Patent [19]

Carmichael

[11] 4,056,088

[45] Nov. 1, 1977

[54] IGNITION SYSTEM

[75] Inventor: Thomas F. Carmichael, Drayton Plains, Mich.

[73] Assignee: Syncro Corporation, Oxford, Mich.

[21] Appl. No.: 460,271

[22] Filed: Apr. 12, 1974

[51] Int. Cl.[2] ..... F02P 3/08

[52] U.S. Cl. ..... 123/148 E; 310/70 A; 310/153

[58] Field of Search ..... 123/148 E, 148 CC; 310/70 R, 153

[56] References Cited

U.S. PATENT DOCUMENTS

| | | | |
|---|---|---|---|
| 3,114,851 | 12/1963 | Santi | 310/153 |
| 3,367,314 | 2/1968 | Hirosawa et al. | 123/148 E |
| 3,464,397 | 9/1969 | Burson | 123/148 CC |
| 3,545,420 | 12/1970 | Foreman | 123/148 CC |
| 3,598,098 | 8/1971 | Sohner | 123/148 CC |
| 3,673,490 | 6/1972 | Magrane | 310/70 R |
| 3,703,889 | 11/1972 | Bodig et al. | 123/148 E |
| 3,821,570 | 6/1974 | Burson | 310/153 |
| 3,941,111 | 3/1976 | Carmichael et al. | 123/148 E |
| Re. 27,477 | 9/1972 | Piteo | 123/148 E |

*Primary Examiner*—Carroll B. Dority, Jr.
*Assistant Examiner*—David D. Reynolds
*Attorney, Agent, or Firm*—Harness, Dickey & Pierce

[57] ABSTRACT

A capacitive discharge ignition system having a charge coil and an ignition coil including primary and secondary windings wound on a common stator structure. The charge coil is coupled to the primary winding of the ignition coil by an SCR and a main capacitor such that the capacitor is first charged by the charge coil and then discharged through the SCR into the primary winding of the ignition coil when the SCR fires. During discharge of the capacitor, the charge coil also supplies current to the primary winding of the ignition coil. A shorted turn is located on one leg of the stator structure and a diode is connected in parallel with the charge coil to reduce the maximum peak potential supplied by the charge coil to reduce the maximum potential rating requirements of the ignition circuit components.

2 Claims, 4 Drawing Figures

IGNITION SYSTEM

BACKGROUND AND SUMMARY OF THE INVENTION

The present invention relates generally to ignition systems for internal combustion engines and in particular to improvements in ignition systems of the capacitor discharge type as disclosed in the copending application of Richard J. Maier and myself for Ignition System, Ser. No. 395,908 filed Sept. 10, 1973 and assigned to the assignee of this application. The teachings of that application are incorporated herein by reference thereto.

In order to reduce the complexity, the number of component parts, the package size, and the cost of capacitor discharge ignition circuits, various circuit arrangements have been tried in an attempt to improve such circuits without sacrificing desired operating performance and reliability. In accordance with such objectives, the prior art includes various circuit arrangements for charging the capacitor during a portion of the engine operating cycle and thereafter discharging the capacitor, through an SCR or the like, at a desired time in the engine cycle.

The aforementioned application is directed to improvements in capacitor discharge ignition systems, and particularly, to a capacitor discharge ignition system having novel features which result in important advantages over prior art capacitor discharge ignition systems, i.e. a capacitor discharge ignition system which can provide excellent performance over a wide range of engine speeds without the complexity generally associated with prior capacitor discharge ignition systems. One of these features of the invention of the aforementioned application is the elimination of a separate winding for providing a trigger signal for the SCR whereby the cost and complexity of the system are reduced. Another feature of the invention of the aforementioned application is the provision of an ignition coil on the stator structure having the charge/trigger winding so that the primary winding of the ignition coil is energized, not only by the discharge of the capacitor, but also simultaneously by the magnetic field used to induce a charging current in the charge/trigger winding so as to increase the power supplied to the spark plug.

The invention of the present application is an improvement in the invention of the aforementioned application in that it provides an ignition system having substantially the same performance as the ignition system of the aforementioned application and yet desirably may utilize circuit components having lower peak potential ratings thereby still further reducing the cost of the system. It will be appreciated that as the peak potential rating of circuit components such as SCR's increases, the cost of these components dramatically increases. It will further be appreciated that in simple electrodynamic devices such as the rotors and stators for use with low-cost engines, irregular potential waveforms result which may have substantial potential peaks or spikes. Consequently, high potential peaks developed by these electrodynamic devices can result in the need for circuit components with very high peak potential ratings.

In accordance with the present invention, an ignition system is provided in accordance with the teachings of the aforementioned application which additionally has a shorted turn about one leg of the stator structure and/or has a diode connected in parallel with the single charging and triggering coil. These components have been found to substantially decrease the maximum peak potential delivered to the circuit components, for example, by approximately 50%. Importantly, and unexpectedly, the use of these devices does not detrimentally reduce the potential developed at the secondary coil at low rotor speeds such as those occurring during cranking of the engine. Accordingly, this discovery is believed to be a significant advance in this art.

BRIEF DESCRIPTION OF THE DRAWINGS

The drawings illustrate preferred embodiments of capacitor discharge ignition systems according to the present invention and in accordance with the best mode presently contemplated for carrying out the invention.

DESCRIPTION OF THE PREFERRED EMBODIMENTS

Figure 1:
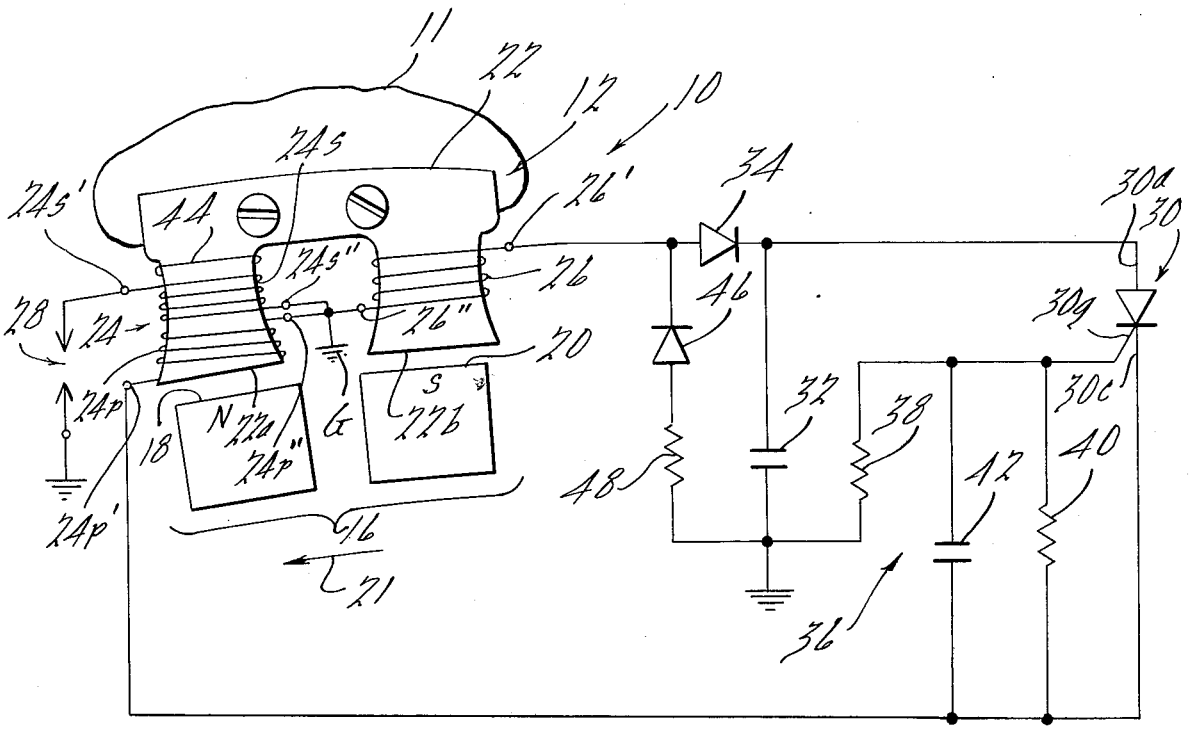
FIG. 1 is a first view, including an electrical schematic diagram, of a first embodiment of a capacitor discharge ignition system according to the present invention.

In FIG. 1, a first embodiment of a capacitor discharge ignition circuit 10 according to the present invention is employed with an internal combustion engine 11. Circuit 10 includes a stator assembly 12 mounted on the housing of engine 11 adjacent the periphery of a rotating element such as the engine flywheel 16. A north magnetic pole 18 and a south magnetic pole 20 are arranged on the flywheel 16 for rotation therewith past the stator 12 as indicated by the arrow 21. As the flywheel 16 rotates past the stator 12, the magnetic flux existing between poles 18 and 20 passes through stator 12 to produce a time varying magnetic flux waveform in stator 12 in accordance with principles well known in the art.

Stator assembly 12 comprises a U-shaped core 22 having legs **22*a* and 22*b*. An ignition coil 24 comprising a primary winding 24*p* and a secondary winding 24*s* is wound on leg 22*a* while a charging coil 26 is wound on leg 22*b*. Winding 24*p* comprises terminals 24*p*' and 24*p*'' and windings 24*s*, terminals 24*s*' and 24*s*''. The coil 26 comprises terminals 26' and 26''. Terminals 24*p*'', 24*s*'' and 26'' are connected to ground G. A spark plug 28 is connected between ground and terminal 24*s*' and hence is across secondary winding 24*s*. (Although a single spark plug is illustrated, it will be appreciated that the invention may be practiced with multiple cylinder engines.) Preferably, coils 24 and 26 are wound on the stator core 22 such that when a voltage is induced in coil 26 which makes terminal 26' positive, a voltage is induced in coil 24 which makes terminal 24*p*'** negative.

Figure 2:
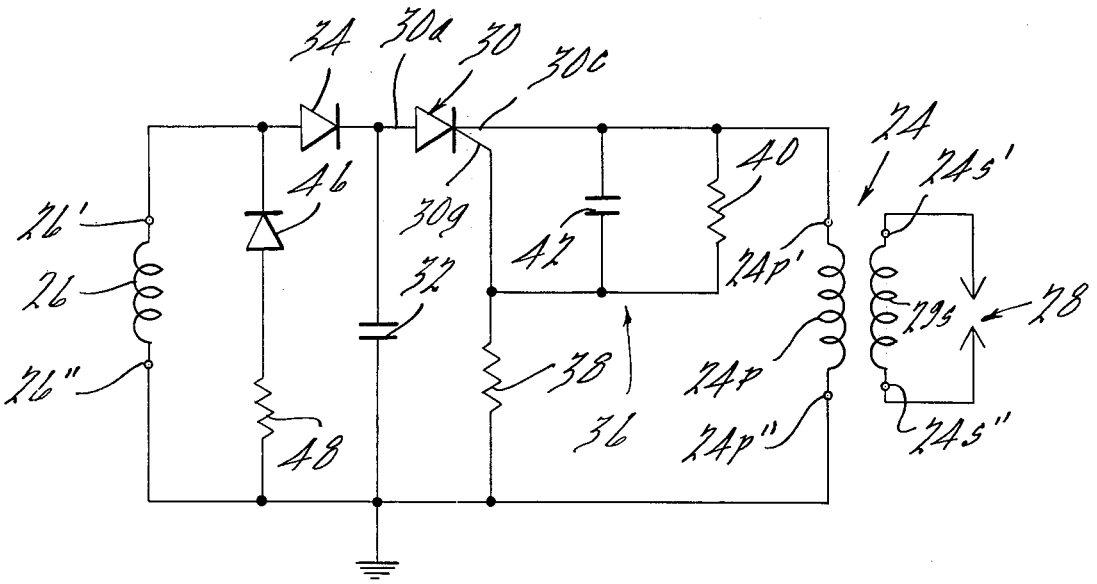
FIG. 2 is a rearranged view of the electrical schematic diagram of FIG. 1.

With reference additionally to FIG. 2, the ignition system 10 further includes an SCR 30, a main charging capacitor 32 which is connected to receive the output of the charging and triggering coil 26 through a diode 34. More specifically, the main charging capacitor 32 is connected to the opposite end of the coil 26 through a ground path so that it receives the positive half-cycles of the waveform of the charging and triggering coil 26 through the diode 34. The capacitor 32, and the diode 34, are connected to the anode 30*a* of the SCR 30 so that the capacitor 32 may be discharged through the SCR 30 and the coil potential may be transmitted through the SCR 30 when the SCR 30 is fired. A gating circuit 36 for the SCR 30 includes resistors 38 and 40 and capacitor 42. More specifically, the resistors 38 and 40 and the capacitor 42 are connected to the gate 30*g* of the SCR 30 to provide a gating potential for the SCR as will be described. The resistor 38 connects the gate 30*g* to ground while the capacitor 42 and the resistor 40 connect the gate 30*g* to the cathode 30*c* of the SCR 30.

In accordance with the present invention, the stator assembly 12 is further provided with a shorted turn 44 on leg 22*a* which may simply be one or more turns of ground conductors about the leg 22*a* or an annular sheet metal stamping if desired. The shorted turn 44 has two ends which are joined by a continuous low impedence path. Optionally, a resistance may be inserted in the path of the shorted turn 44 to reduce its effects. Also in accordance with the present invention, a series circuit of a shunting diode 46 and an optional shunting resistor 48 is connected in parallel with and directly across the charging and triggering coil 26. The diode is arranged so that the negative half-cycles are shunted through the diode 46 and the resistor 48 so that the diode 46 and the diode 34 constitute steering diodes with the diode 34 transmitting positive half-cycles of the charging coil waveform while the diode 46 transmits negative half-cycles of the charging coil waveform.

Ignition system 10 operates as follows. As flywheel 16 rotates, magnets 18 and 20 create a time varying magnetic flux in stator core 22. This time varying flux induces a voltage in coil 26 whose waveform includes repetitive positive and negative polarity output pulses which appear at terminal 26'. Since capacitor 32 is coupled to coil 26 through diode 34, current flows from coil 26 in response to an initial portion of each positive pulse to charge capacitor 32. As explained in the aforementioned application, the charging diode 34 can be eliminated and resonant charging effects of the capacitor 32 can be utilized.

In the particular embodiments shown in this application, the triggering current for the SCR 30 is derived from the primary winding of the ignition coil 24 by means of a resistor 40 and capacitor 42. However, it will be understood that the triggering current can also be derived from the charge coil 26 in the manner set forth in the aforementioned application. The effect of the resistive and capacitive elements 38, 40 and 42 can be best summarized as follows. Assuming for the moment that capacitor 42, resistor 38 and resistor 40 are not electrically connected in circuit, SCR 30 will fire via a breakdown effect for engine speeds as low as about 350–400 rpm. When resistor 38 is added, SCR 30 can fire at engine speeds as low as about 100 rpm. By further adding capacitor 42, the lowest engine speed at which SCR 30 will fire is even further reduced to approximately 50 rpm. The provision of resistor 40 keeps the spark from retarding at very high engine rpm. Furthermore, it has been observed that the kilovolt output of spark plug 28 is substantially increased at these relatively low engine rpm, and it is believed that this may be due to a ringing effect provided by the capacitor. Thus it can be seen that with the appropriate selection of specific circuit component values, desired operational circuit performance for small gasoline engine ignition system application can be attained with a minimum of circuit complexity. It is preferred to empirically determine specific component values for a given application.

It has been discovered that diode 34, in addition to providing a charging path for the capacitor 32, alleviates the effects of spikes which may occur in the output waveform developed across coil 26. More specifically, with certain stator and rotor constructions, it has been observed that the output waveform of the charging coil can contain multiple spikes which may not be desirable. It has been found that the number of excess spikes (i.e., spikes in excess of one for single cylinder engines) can be minimized or eliminated by incorporating diode 34 and/or by changing the resistance of resistor 38. It has been found that increasing the resistance of resistor 38 helps to minimize the number of excess spikes.

Although the ignition system of the aforementioned application operated very satisfactorily, it was discovered that the peak potentials delivered to the SCR 30 were quite high, and accordingly, an SCR was required which had a high peak potential rating. The cost of SCR's with high ratings was sufficiently high as to have a significant effect on the overall cost of the ignition system.

It is apparent that the shorting coil 44 diverts or absorbs some of the flux in the stator core 22 by virtue of the short circuit current induced in the coil 44 as the flux through the stator core 22 varies. It would be expected that the net result of the use of the shorted turn 44 would be to reduce the potential supplied to the ignition circuit at all engine speeds. This would have adversely affected the ability of the ignition system to produce a suitable spark at the critical cranking speeds. Unexpectedly, on actual experimentation, it was discovered that the use of the shorted turn 44 does in fact reduce the maximum peak potential supplied to the SCR 30 but does not reduce the potential supplied to the spark plug 28 at low engine speeds such as those occurring during cranking. Accordingly, the shorted turn 44 provides the benefit of reducing the peak potential supplied to the SCR 30 so that a lower cost SCR having a lower peak potential rating can be used, but does not give the expected disadvantage of lower, and possibly unacceptable, cranking voltages. Although the reason why this benefit has been obtained is not understood, it is probably the result of the novel combination of the ignition system circuit and the stator having the shunted turn 44.

It is further apparent that the diode 46 will shunt at least a portion of one-half of the waveform of the charging coil 26 which will tend to suppress the flux in the stator core 22 so as to also reduce at least a portion of the other half of the waveform. This effect would also expectedly yield lower potential throughout the speed range. However, through actual experimentation, it has been determined that although the maximum peak potential supplied to the SCR has been reduced to reduce the rating requirement for the SCR, the potential supplied to the spark plug 28 at low engine speeds has not been reduced. It is believed that in most cases, the resistor 48 which is in series with the diode 46 is desirable. However, beneficial effects can still be obtained using the diode 46 without the conjunctive use of the resistor 48. Again, although the reason why this benefit has been obtained is not understood, it is probably the result of the novel combination of the ignition system circuit and the shunting diode 46.

In the first embodiment of an exemplary ignition system according to the present invention, circuit components having the following values were used:

| SCR 30 | G.E. C107B1X1 |
|---|---|
| Capacitor 32 | .30 microfarads |
| Resistor 38 | 22 kilohms |
| Capacitor 42 | .22 microfarads |
| Resistor 40 | 22 kilohms |
| Resistor 48 | 3 kilohms |

Figure 3:
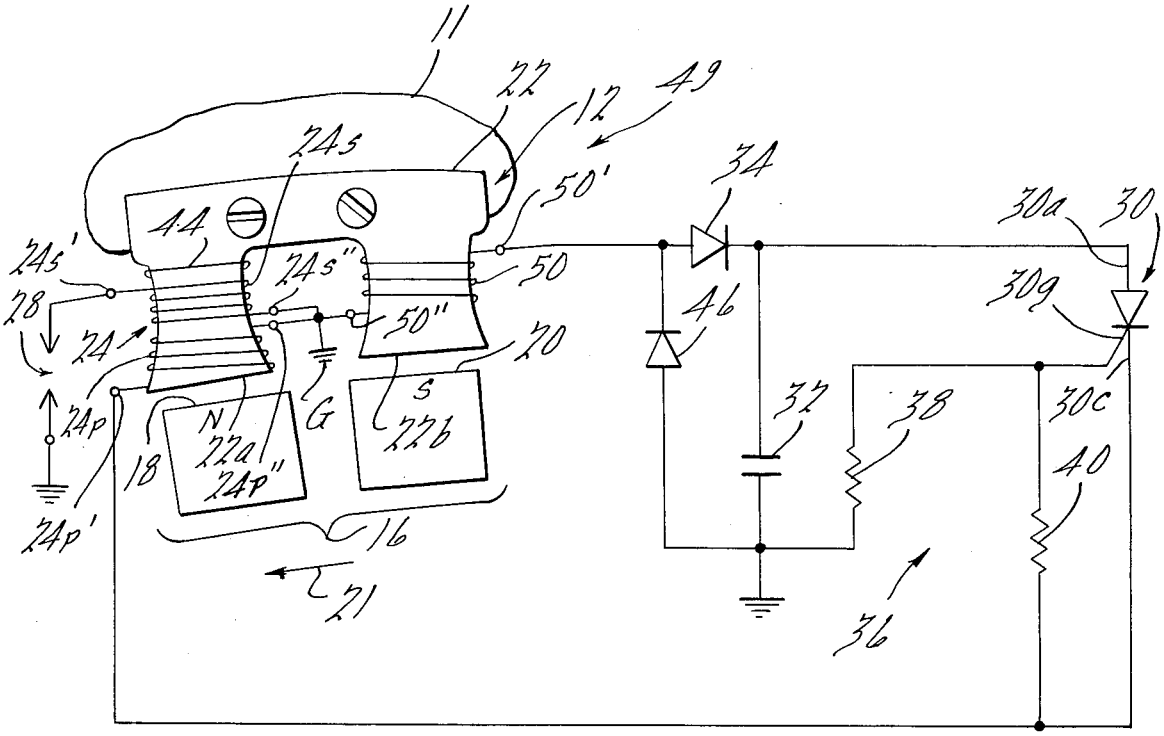
FIG. 3 is a first view, including an electrical schematic diagram, of a second embodiment of a capacitor discharge ignition system according to the present invention.
Figure 4:
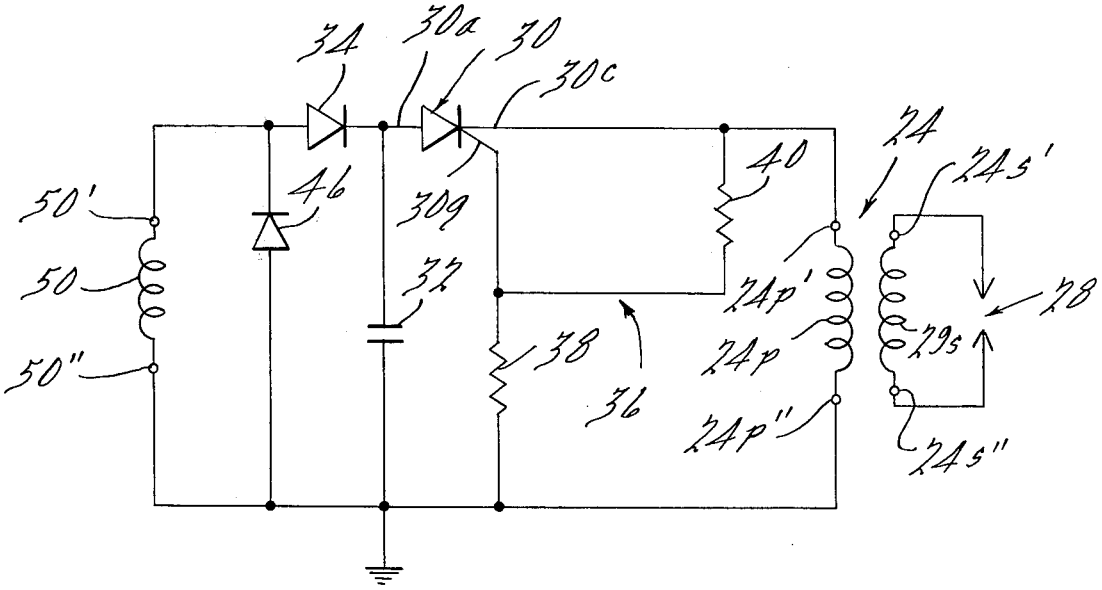
FIG. 4 is a rearranged view of the electrical schematic diagram of FIG. 3.

In FIGS. 3 and 4, a second embodiment of an ignition system 49 according to the present invention is illustrated. In the embodiment of FIGS. 3 and 4, like components have been provided with like numbers.

The ignition system 49 of FIGS. 3 and 4 differs from the ignition system 19 of FIGS. 1 and 2 in three respects. Firstly, the charge coil for charging the capacitor 32, indicated as 50 in FIGS. 3 and 4, is wound in the opposite sense so that the voltage induced therein is in opposition to the voltage induced in the primary winding 24*p* of the ignition coil 24. Secondly, it has been found that the gating capacitor 42 of FIGS. 1 and 2 is not necessary when the charging coil 50 is wound in opposition as shown in FIG. 3. Thirdly, it has been found that, in the embodiment of FIGS. 3 and 4, best performance is achieved without the shunting resistor 48 of the embodiment of FIGS. 1 and 2. The opposed charge winding 50 provides a reduction in the maximum potential applied to the SCR 30 in addition to the reduction provided by the shorted turn 44 and the shunting diode 46. Accordingly, this provision may be used in combination with both or either of the shorted turn 44 and the shunting diode 46, or separately, if desired.

During the actual operation of the ignition system 49 of FIGS. 3 and 4, it was found that the ignition system would provide an advance in an ignition timing of approximately 8° to 10° with advancing engine speed. This effect, of course, is highly desirable. Although the exact cause of the advance is not fully understood, it may be in part a function of the spacing of the legs 22*a* and 22*b* of the stator structure 22. More particularly, the poles 18 and 20 are arranged and constructed in relation to stator 12 such that a first imaginary radial line circumferentially bisecting the radially outer face of pole 18 and a second imaginary radial line circumferentially bisecting the radially outer face of pole 20 have a smaller angular separation than does a third imaginary radial line circumferentially bisecting the radially inner face of leg 22*b* and a fourth imaginary radial line bisecting the radially inner face of leg 22*a*. In other words, the angular separation between the midpoints of legs 22*a* and 22*b* as measured circumferentially across the stator gap is greater than the angular separation between the midpoints of the two poles 18 and 20.

In the second embodiment of an exemplary ignition system according to the present invention, circuit components having the following values were used:

| SCR 30 | G.E. C107B1X1 |
|---|---|
| Capacitor 32 | .50 microfarads |

-continued

| SCR 30 | G.E. C107B1X1 |
|---|---|
| Resistor 38 | 10 kilohms |
| Capacitor 42 | .22 microfarads |
| Resistor 40 | 7 kilohms |
| Resistor 48 | 3 kilohms |

It is to be understood that the foregoing description is that of preferred embodiments of the invention. Various changes and modifications may be made without departing from the spirit and scope of the invention as defined by the appended claims.

What is claimed is:

1. A capacitor discharge ignition system for delivering a secondary potential to a spark plug and incorporating circuit components with limited peak potential rating comprising:

an ignition coil having a primary and a secondary winding coil for connection to a spark plug, a stator core on which said primary and secondary windings are disposed, a shorted winding on said stator core for reducing the maximum peak potential delivered to said ignition system circuit components with limited peak potential rating without detrimentally reducing said secondary potential delivered to said spark plug at low rotor speeds relative to the same ignition system without said shorted winding, a magnetic structure including a north magnetic pole and a south magnetic pole for energizing said primary winding through said stator core with a time-varying magnetic flux such that said primary winding generates an output waveform which includes repetitive pulses of one polarity, a spark plug, a main capacitor, a charge coil also disposed on said stator core being energized by said time-varying magnetic flux provided by said north and south magnetic poles for energizing said main capacitor, diode means connected in parallel with said charging coil for reducing the maximum peak potential delivered to said ignition system circuit components with limited peak potential rating without detrimentally reducing said secondary potential delivered to said spark plug at low rotor speeds relative to the same ignition system without said diode means, a solid state switch means connecting said capacitor to said primary winding, said solid state switch means being arranged to conduct current from said capacitor to said primary winding in response to a trigger signal, and triggering circuit means coupling said primary coil and said solid state switch means such that said solid state switch means is rendered conductive in response to a trigger signal derived from said pulses generated by said primary winding upon energization thereof by said time-varying magnetic flux provided by said north and south magnetic poles, which trigger signal occurs after said capacitor has been energized.

2. An ignition system according to claim 1 further including a resistor connected in series with said diode means.

* * * * *